United States Patent [19]

Schuit

[11] Patent Number: 4,801,280

[45] Date of Patent: Jan. 31, 1989

[54] STATOR FOR MARINE PROPELLER

[76] Inventor: Johannes Schuit, 1433 Camilo Trillado, Carpinteria, Calif. 93013

[21] Appl. No.: 567,686

[22] Filed: Jan. 3, 1984

[51] Int. Cl.[4] ..... B63H 1/14

[52] U.S. Cl. ..... 440/67; 440/71

[58] Field of Search ..... 440/38, 66, 67, 68, 440/69, 70, 71; 60/221, 222

[56] References Cited

U.S. PATENT DOCUMENTS

| | | | |
|---|---|---|---|
| 748,176 | 12/1903 | Eastwood . | |
| 1,986,750 | 1/1935 | Ring . | |
| 2,139,594 | 12/1938 | Kort . | |
| 2,320,451 | 6/1943 | Akins | 440/67 |
| 2,896,565 | 7/1959 | Stevens . | |
| 3,608,512 | 9/1971 | Thompson . | |
| 3,658,028 | 4/1972 | Koons . | |
| 4,288,223 | 9/1981 | Gonzalez et al. | 440/67 |

FOREIGN PATENT DOCUMENTS

| | | | |
|---|---|---|---|
| 1181090 | 11/1964 | Fed. Rep. of Germany | 440/67 |
| 2346035 | 3/1974 | Fed. Rep. of Germany | 440/67 |
| 1387903 | 11/1965 | France | 440/67 |
| 115892 | 9/1979 | Japan | 440/67 |
| 2028237 | 3/1980 | United Kingdom | 440/67 |

*Primary Examiner*—Sherman D. Basinger
*Assistant Examiner*—Stephen P. Avila
*Attorney, Agent, or Firm*—William W. Haefliger

[57] ABSTRACT

A flow guide is employed with a marine propeller having blades, and:

(a) the guide is substantially cylindrical and has fore and aft opposite ends, (b) the propeller has an axis of rotation, and said flow guide has an axis, said axes being substantially coincident, (c) the flow guide having a rim defining a bore diameter at said aft end which is substantially the same as the propeller blade tip diameter, and (d) the blades having tips and the propeller having a location characterized in that the blade tips rotate adjacent said rim at the aft end of the flow guide. Typically, the guide is mounted to the hull so that the guide axis extends downwardly and rearwardly, at an angle to horizontal.

4 Claims, 2 Drawing Sheets

3
3
10
20
16d
21
16aa
24
16b
16a
29
32
38
30a
30b
29a
14
17
12
15
16c
23'
23'
29
23b
β
31
23c
γ
23a
23
24
16

10
24
24
25
25
26
29
29
17
15
12
16

STATOR FOR MARINE PROPELLER

BACKGROUND OF THE INVENTION

This invention relates generally to the prevention of breakage of marine propellers and their shafts; and more particularly to flow guide structure characterized as cooperating with a propeller to achieve this purpose, and additional advantages, as will appear.

Conventional propeller installations are characterized by tendencies for fatigue fracturing at blade root areas, and at drive shafts near the propellers. Analysis reveals that a propeller's axis of rotation is not parallel to the direction of water flow entering the propeller zone, and the thrust induced upon the blades is not the same at all phases of revolution. Thus, as a curved or angled blade rotates relatively downwardly, (for example at 9 o'clock rotation angle), the water loading thereon is different than the loading on the blade as it rotates relatively upwardly (for example at 3 o'clock rotation angle). The blade can as a result be cyclically unloaded and overloaded as it rotates, leading to fatigue and breakage of propeller blades and shafts, due to bending fatigue, and also cavitation.

Further, a condition called stern vibration or rumble is a common occurrence especially with the installation of two or four bladed propellers. In the case of a two bladed propeller, a full unloading and overloading of the propeller blades occur each ½ revolution, and for a four bladed propeller the same occurs each one fourth revolution. It is in general not practical to install a through hull propeller shaft, to extend axially parallel to the flow of water past the hull, so that the plane of propeller rotation is perpendicular to the water flow direction.

SUMMARY OF THE INVENTION

It is a major object of the invention to provide apparatus overcoming the above problems. Basically, the invention is embodied in apparatus for combination with a marine propeller having blades of (a) a substantially cylindrical flow guide having fore and aft opposite ends, (b) the propeller having an axis of rotation, and said flow guide having an axis, said axes being substantially coincident, (c) the flow guide having a rim defining a base diameter at said aft end which is substantially the same as the propeller blade tip diameter, and (d) said blades having tips and the propeller having a location characterized in that the blade tips rotate adjacent said rim at the aft end of the flow guide.

As will be seen, the blades are typically located at least in part outside the flow guide aft end; the flow guide has struts between the hub and body to define space for guided flow between the struts; and the strut typically comprises stator vanes mounted to the guide and hub and angled to direct the flow in the guide into the propeller blades, for increasing the efficiency of propulsion. In addition, the flow guide has length about equal to its bore diameter, which in turn is about equal to the propeller blade tip diameter. As a result, a number of unusual advantages and results are combined, as will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
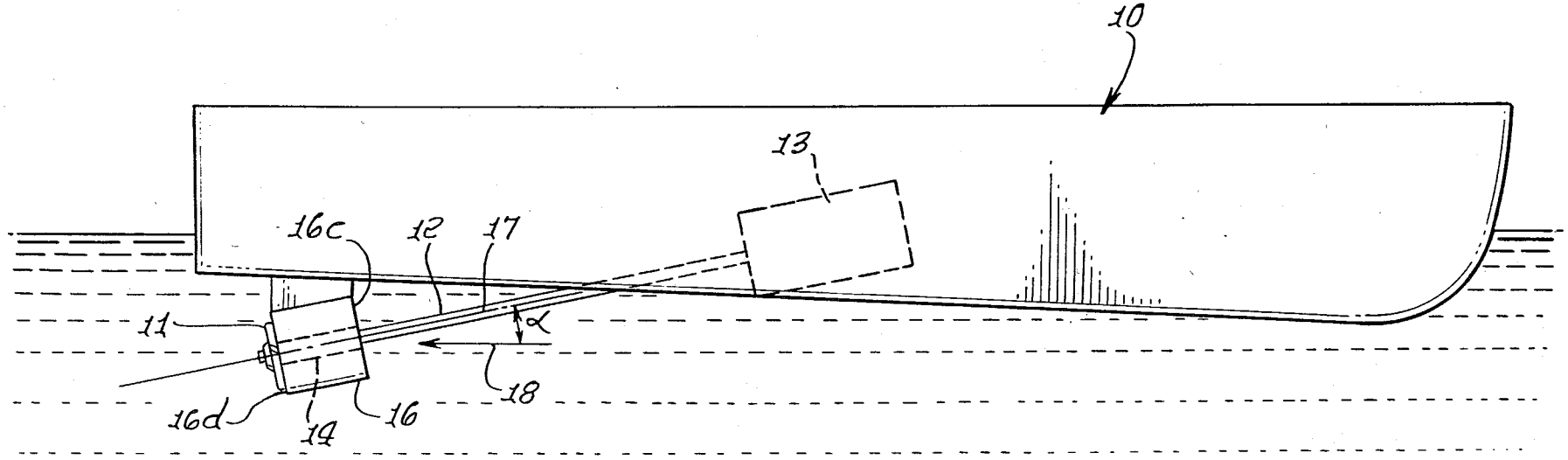
FIG. 1 is a side elevation showing a ship's hull, propeller and flow guide.
Figure 2:
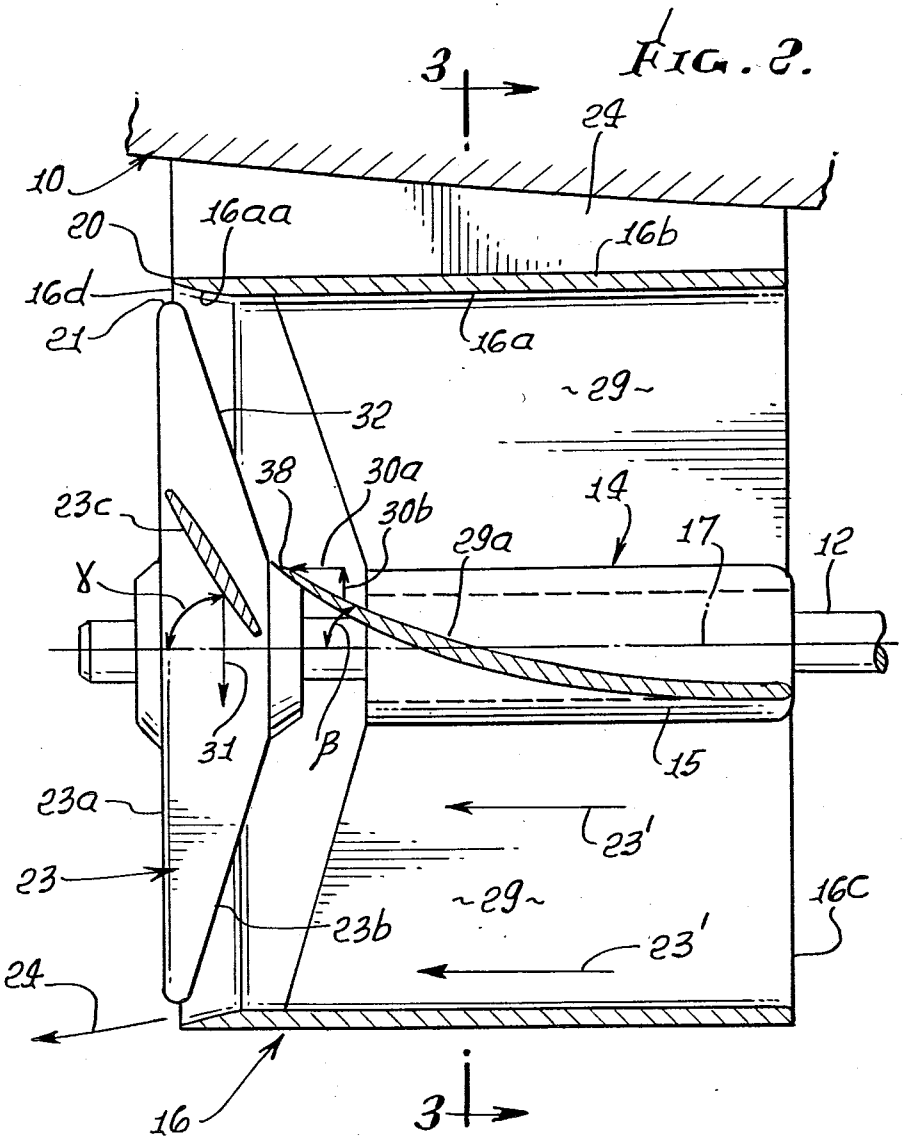
FIG. 2 is a side elevation showing details of the propeller and shroud.
Figure 3:
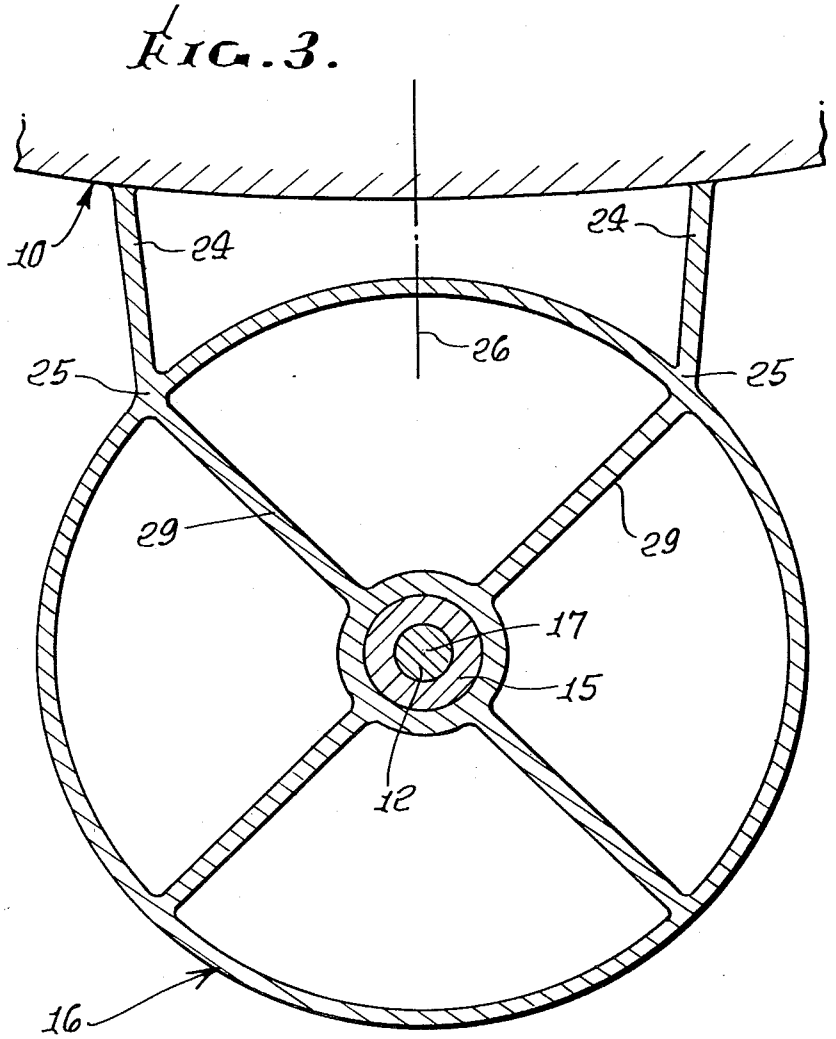
FIG. 3 is a section through the flow guide, on lines 3—3 of FIG. 2.

In FIGS. 1 to 3, a ship's hull is designated at 10, and a propeller 11 is rotated by a shaft 12 extending from a power plant 13. An outboard bearing for the shaft is shown at 14 received in a hub 15. The latter is supported by a substantially cylindrical flow guide 16 having inner and outer walls **16*a* and 16*b*, and fore and aft ends 16*c* and 16*d*. The flow guide is typically metallic and has an axis 17 coincident with the axis of propeller rotation. An important function of the flow guide is to cause the water flow entering the guide in the direction of arrow 18 (at an angle l to axis 17) to turn the flow in the direction of axis 17, so as to pass through the propeller blades generally normal to a disc defined by a point on a blade as it rotates. Therefore, the thrust induced upon the blades is generally the same—i.e., even—at all phases of blade revolution. The water line is shown at 49**.

It will be noted from FIG. 2 that the guide 16 has a circular rim 20 defining a bore diameter at the aft end **16*d* which is substantially the same as but typically slightly larger than the diameter of the circle defined by the propeller blade tips 21 as they rotate. FIG. 2 shows that the base 16*a* tapers outwardly at 16*aa* as it approaches rim 20, allowing for flow divergence radially, as the flow passes through the propeller. Accordingly, the propeller has a location characterized in that the blade tips rotate closely adjacent the rim at the aft end of the guide, yet accommodating radially outwardly travel of the flow passing through the propeller so as not to restrict propeller efficiency. Note that the blades 23 are located at least in part outside the flow guide, as at 23*a*, and at least in part within the guide, as at 23*b***.

Means is provided to mount the flow guide to the hull. In the example, such means include struts **24*a* which are laterally spaced and extend downward from the hull 10 to the upper portion of the guide 25. Connections 25 are located at equal spacings from and at opposite sides of a vertical plane 26 passing through axis 17**.

Flow guiding strut means is also provided between the cylindrical flow guide 16 and the hub 15 to mount the hub. Such strut means typically include multiple struts 29 extending generally radially and connected to the guide 16 and to the hub at multiple locations, as shown. The struts extend from the inlet end **16*c* of the guide 16 in rearward direction, but with curvature, to also define stator vanes directing the flow into the propeller. For example, each stator vane has a flow directing generally concave face 29*a* curved rearwardly (see arrow 30*a*), and in a circumferential direction (see arrow 30*b*) in a direction opposite to the rotary direction (see arrow 31) of rotation a propeller blade 23*c*. Thus, each vane surface 29*a* extends at an angle (such as $\beta$) which is directionally generally the same as the angle (such as $\gamma$) of the blade passing the vane, relative to a plane containing axis 17 and intersecting the vane. The vanes terminate at tapered edges 38 angled as shown to be generally parallel to and spaced from the cone 32** defined by propeller forward extents 23*b*, in the guide 16. Note also that the flow guide 16 preferably has axial length approximately equal to its bore diameter.

Unusual advantages of the construction include induced guidance of the flow into the propeller blades, and in such manner that blades are equally loaded as they rotate, despite angularity of axis 17 relative to the relative direction of water flow into the forward end of the guide 16; use of the curved vanes 29 to guide the flow angularly into the blades, for higher efficiency, and to mount the hub 15 for the propeller shaft; and location of the propeller at the aft end of the guide 16 to permit water flow radially outwardly of the propeller as the water flows through the propeller.

I claim:

1. For combination with a marine propeller having blades, and adapted for connection to a ship's hull, (a) a substantially cylindrical flow guide having fore and aft opposite ends, (b) the propeller having an axis of rotation, and said flow guide having an axis, said axes being substantially coincident, (c) the flow guide having a rim defining a bore diameter at said aft end which is substantially the same as the propeller blade tip diameter, and (d) said blades having tips and the propeller having a location characterized in that the blade tips rotate adjacent said rim at the aft end of the flow guide, (e) the blades located partly within, and partly outside the flow guide so that the blade tips rotate closely adjacent said rim, the blades tapering forwardly between said tips and said propeller axis, (f) the flow guide having an outer cylindrical body, a tubular hub, and struts extending between said hub and said body, there being flow space between said hub and body, the propeller having a shaft extending through said hub, (g) the struts comprising multiple stator vanes mounted to the guide and located in said flow space and spaced about the hub to direct the flow of water rearwardly and directionally circumferentially into the rotating blades, each vane having a flow directing face which extends rearwardly and circumferentially in a direction opposite to the rotary direction of blade rotation.

(h) the vanes including said flow directing faces extending generally axially throughout the major length of the flow guide, and rearwardly into proximity to said flow guide rim, whereby water flowing through the major length of the flow guide is directed both axially and circumferentially.

2. The combination of claim 1 including a ship's hull, and strut means mounting said flow guide to said hull to extend therebetween.

3. The combination of claim 1 wherein the flow guide bore has a diameter substantially equal to its axial length.

4. The combination of claim 2 including said propeller, with blades located partly within said flow guide and partly outside the flow guide at the aft end thereof, the guide having a bore section which diverges rearwardly at the aft end of the guide, the flow guide axis extending downwardly and rearwardly at an angle relative to horizontal.

* * * * *